US005853241A

United States Patent [19]

Sharrah et al.

[11] Patent Number: 5,853,241

[45] Date of Patent: Dec. 29, 1998

[54] CONVERTIBLE FLASHLIGHT

[75] Inventors: Raymond Sharrah, Collegeville; Charles Craft, Lansdale; John DiNenna, Bridgeport, all of Pa.; Ludwin Mora, Columbus, Ohio

[73] Assignee: Streamlight, Inc., Norristown, Pa.

[21] Appl. No.: 693,484

[22] Filed: Aug. 8, 1996

Related U.S. Application Data

[60] Provisional application No. 60/005,490 Oct. 16, 1995.

[51] Int. Cl.[6] ..... F21L 7/00

[52] U.S. Cl. ..... 362/105; 362/191; 362/199; 362/196; 362/197

[58] Field of Search ..... 362/103, 105, 362/190, 191, 199, 197, 196

[56] References Cited

U.S. PATENT DOCUMENTS

| | | | |
|---|---|---|---|
| 2,794,908 | 6/1957 | Evans | 362/105 |
| 2,947,851 | 8/1960 | Lozeau . | |
| 3,341,701 | 9/1967 | Moore et al. . | |
| 4,400,763 | 8/1983 | Kribs et al. . | |
| 4,447,863 | 5/1984 | Fenne . | |
| 4,597,031 | 6/1986 | Tsuyama . | |
| 4,916,596 | 4/1990 | Sharrah et al. . | |
| 5,239,451 | 8/1993 | Menke et al. | 362/199 |
| 5,595,436 | 1/1997 | Way, Jr. et al. | 362/190 |

FOREIGN PATENT DOCUMENTS 10597 8/1913 United Kingdom .

*Primary Examiner*—Thomas M. Sember
*Attorney, Agent, or Firm*—Dann, Dorfman, Herrell & Skillman, P.C.

[57] ABSTRACT

A convertible flashlight (10) is provided having a head portion (12, 14) containing a lamp (36). A pair of divergent rear surfaces (15*a,* 15*b*) are formed on the head portion (12, 14), and a pair of rearwardly-extending arms (16*a,* 16*b*) having complementary forward surfaces are joined to the rear surfaces of the head portion by axial-pivotal connections (45*a,* 45*b*). In a first configuration, the arms extend rearwardly in parallel to provide a handle for configuring the flashlight in a hand-held configuration. When the arms (16*a,* 16*b*) are rotated about the axial-pivotal connections to the head portion (12, 14), the distal ends of the arms are moved apart so that the convertible flashlight assumes a second configuration, wherein the arms diverge outwardly from the respective rear surfaces of the head portion (12, 14) to provide a mounting surface to facilitate mounting the convertible flashlight to the head of a user. The arms (16*a,* 16*b*) are provided with resilient removable cover members (24*a,* 24*b*) for access to battery compartments formed within the arms. The resilient cover members (24*a,* 24*b*) form the exterior surfaces of the arms to provide a comfortable grip in the first configuration, and a resilient head-mounting surface in the second configuration.

19 Claims, 5 Drawing Sheets

CONVERTIBLE FLASHLIGHT

CROSS-REFERENCE TO RELATED APPLICATIONS

This application claims priority under 35 U.S.C. §119(e)(1) to U.S. Provisional application No. 60/005,490, filed Oct. 16, 1995.

FIELD OF THE INVENTION

The present invention relates to a flashlight that is convertible between a hand-held configuration and a body-mountable configuration.

BACKGROUND OF THE INVENTION

Hand-held flashlights are known for providing a portable source of illumination. Often, a flashlight user may be required to use both hands for a task while desiring to maintain illumination in an area of interest. It is desirable in such a situation to use a headlamp of the type worn by miners, but such headlamps do not provide all of the advantages of hand-held flashlights. It is therefore desirable to provide a flashlight that is convertible between a hand-held configuration and a body-mountable configuration.

U.S. Pat. No. 4,916,596, describes a convertible flashlight having a pair of articulated arms that are connected to a head assembly by a hinge allowing the arms to pivot transversely and outwardly to provide rearward-facing surfaces for mounting the flashlight to a user's head. A latch is provided for keeping the arms together in the hand-held configuration. In the head-mounted configuration, the hinged connections between the arms and the head forms a gap between the rear surfaces of the arms. It would be desirable to provide a convertible flashlight requiring fewer parts and providing a more comfortable head-mounted configuration.

SUMMARY OF THE INVENTION

In accordance with the present invention, a convertible flashlight is provided having a head portion containing a lamp. A pair of divergent rear surfaces are formed on the head portion, and a pair of rearwardly-extending arms having complementary forward surfaces are joined to the rear surfaces of the head portion by an axial-pivotal connection. In a first configuration, the arms extend rearwardly in parallel to provide a handle for configuring the device in a general flashlight arrangement. When the arms are rotated about the axial-pivotal connection to the head portion, the distal ends of the arms are moved apart so that the convertible flashlight assumes a second configuration, wherein the arms diverge outwardly from the respective rear surfaces of the head portion to provide a mounting surface to facilitate mounting the convertible flashlight to the head of the user. The arms are provided with resilient removable cover members for access to battery compartments formed within the arms. The resilient cover members form the exterior surfaces of the arms to provide a comfortable grip in the first configuration, and a resilient head-mounting surface in the second configuration.

BRIEF DESCRIPTION OF THE DRAWINGS

Additional aspects and advantages of the present invention will be made apparent in the following detailed description in which.

DETAILED DESCRIPTION

Figure 1:
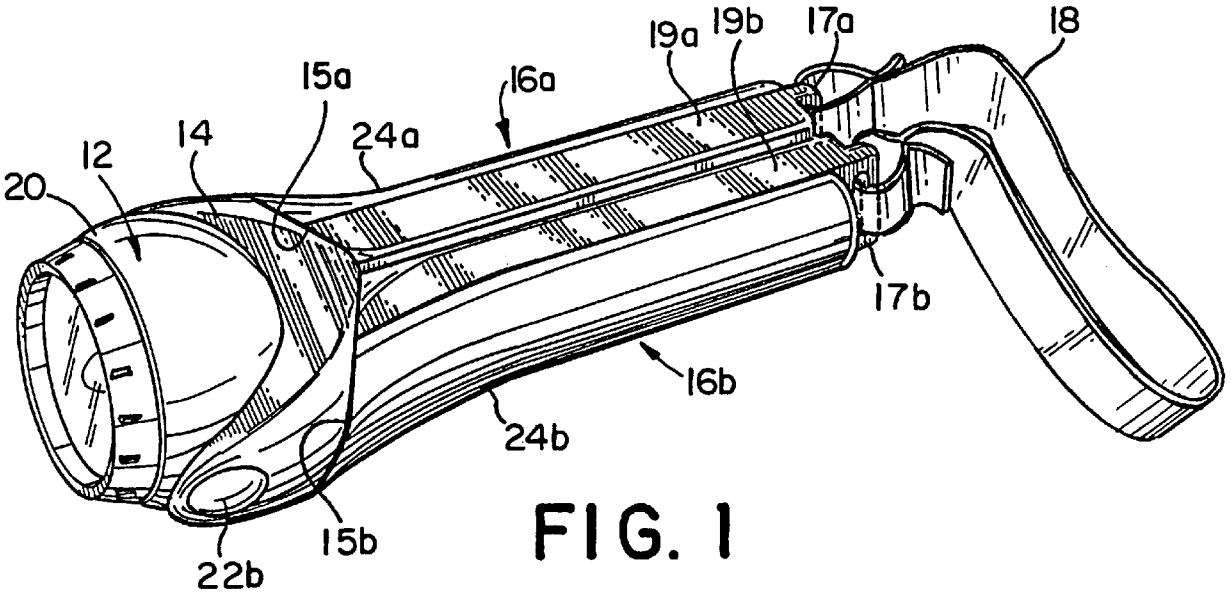
FIG. 1 is a perspective view of a flashlight according to the invention, shown in a hand-held configuration.

Referring now to FIG. 1, there is shown a flashlight 10 comprising a head assembly 12, a yoke 14 for receiving the head assembly 12, and a pair of arms 16*a* and 16*b* pivotally connected to the yoke and extending rearwardly therefrom. An elastic strap 18 is connected at respective distal ends of the arms by suitable attachment means, such as eyelets 17*a* and 17*b*, provided on the distal ends of the arms 16*a* and 16*b*.

Figure 2:
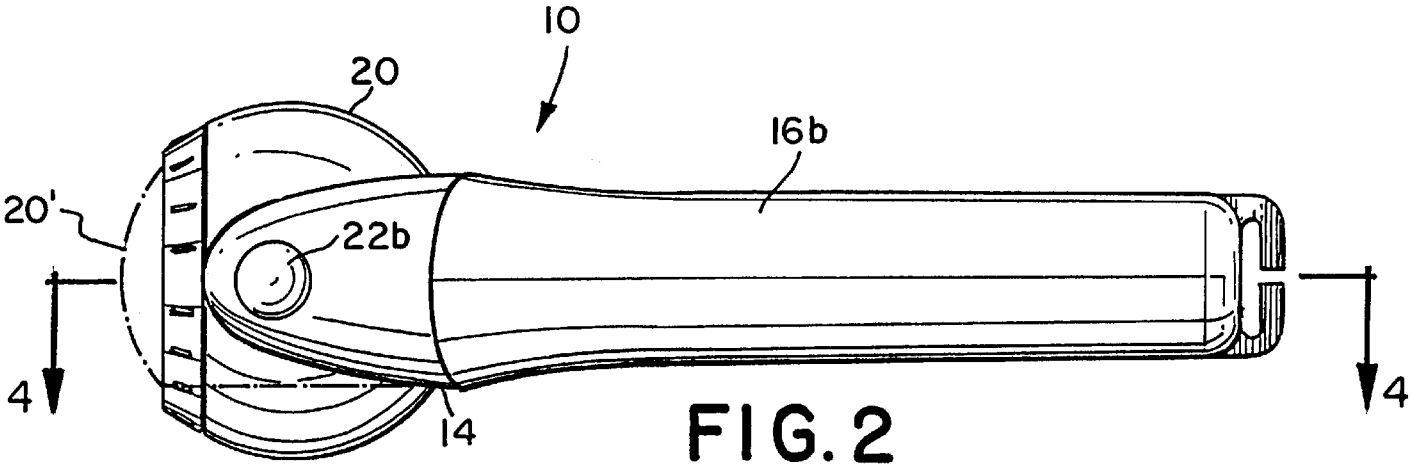
FIG. 2 is a side elevational view of the flashlight and showing the head in alternative positions.

The head assembly 12 comprises a head housing 20 that is pivotally connected to the yoke 14. A pair of pivot pins, of which pivot pin 22*b* is representative, extend through respective sides of the yoke 14 and into the housing 20 on opposite sides thereof. As shown in FIG. 2, the pivotal connection provided by the pins between the yoke 14 and the head housing 20 allows the head to be rotated about a transverse axis, which is defined by the pivots 22*a* and 22*b* relative to the longitudinal axis provided by the arms of the flashlight 10. The range of rotation of the head assembly about the pivots 22*a* and 22*b* is preferably between about 170° to about 180°, which is sufficient to permit the housing 20 to be oriented into the alternative position shown in FIG. 2 and labeled 20; so that light can be projected at a range of angles, including substantially at right angles, from the longitudinal axis of the flashlight.

Referring again to FIG. 1, the bottom of the yoke 14 is generally wedge or V-shaped to provide planar rear surfaces 15*a* and 15*b*, which generally intersect and are divergently angled. The angled rear surfaces 15*a* and 15*b* receive the arms 16*a* and 16*b*, respectively. The forward ends of the arms 16*a* and 16*b* have complementary surfaces formed thereon for mating with respective rear or angled surfaces 15*a* and 15*b* of the yoke 14, so that the arms 16*a* and 16*b* in one configuration of the flashlight extend rearwardly in parallel relationship from the yoke 14.

The arms 16*a* and 16*b* in their parallel relationship provide a handle for gripping or holding the flashlight in a normal hand-held manner. The arms 16*a* and 16*b* are hollow or cup-shaped to provide housings or battery compartments 19*a* and 19*b*. Access to the battery compartments 19*a* and 19*b* is provided by covers 24*a* and 24*b*, respectively, which provide the left and right side grips of the handle. The covers 24*a* and 24*b* are detachable from the housings 19*a* and 19*b* for permitting replacement of batteries. The left and right sides of the flashlight are contoured or gradually tapered toward the yoke outward so that the handle of the flashlight is relatively wider near the junction with the yoke, and narrower at the distal or rear end. The covers 24*a* and 24*b* are preferably formed of a resilient material, such as rubber, to provide cushioned gripping surfaces along the sides of the flashlight.

Figure 3:
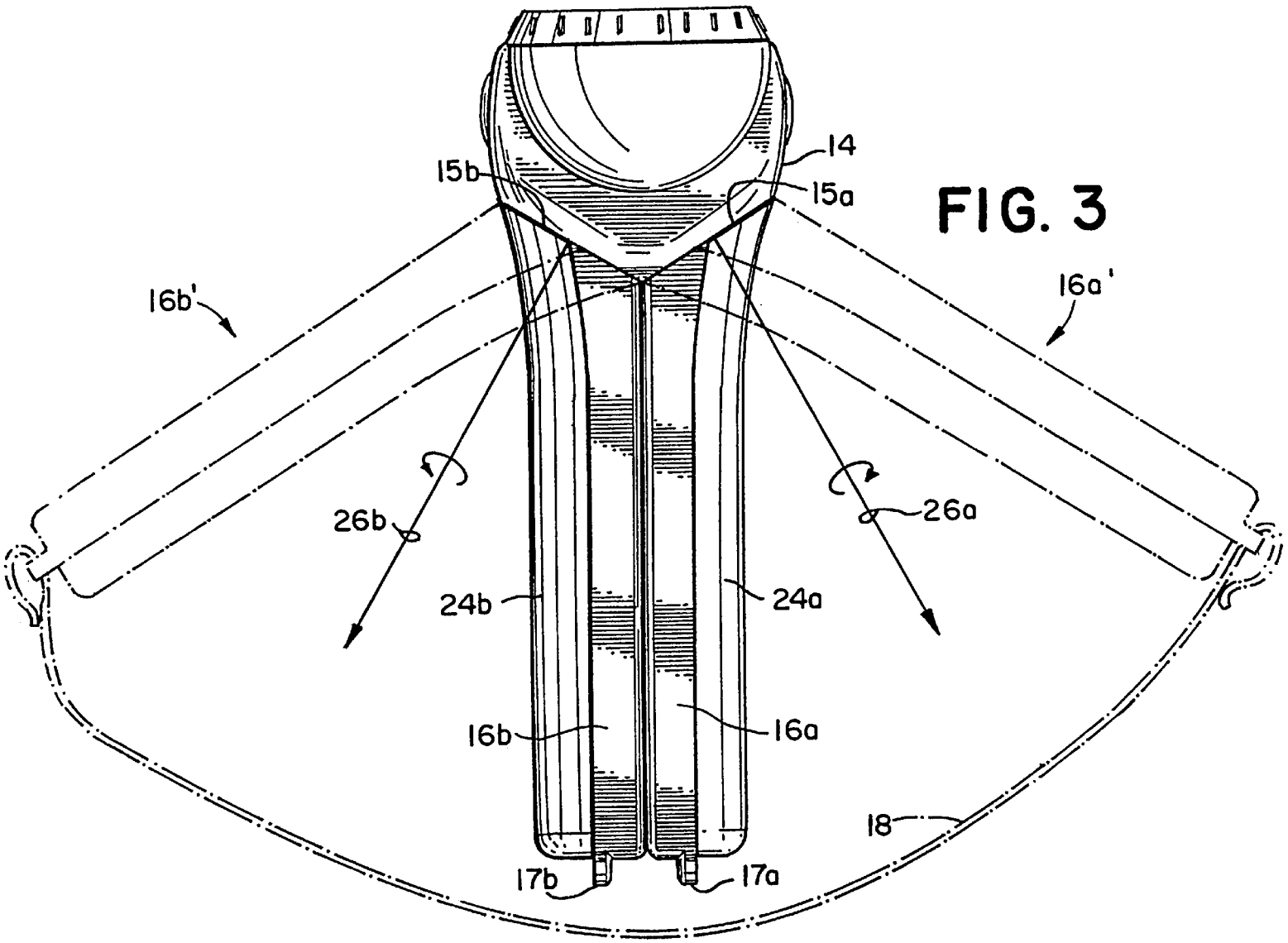
FIG. 3 is a top plan view of the flashlight of the present invention showing the arms of the flashlight in alternative positions for hand-held use and body-mountable use of the flashlight.
Figure 8:
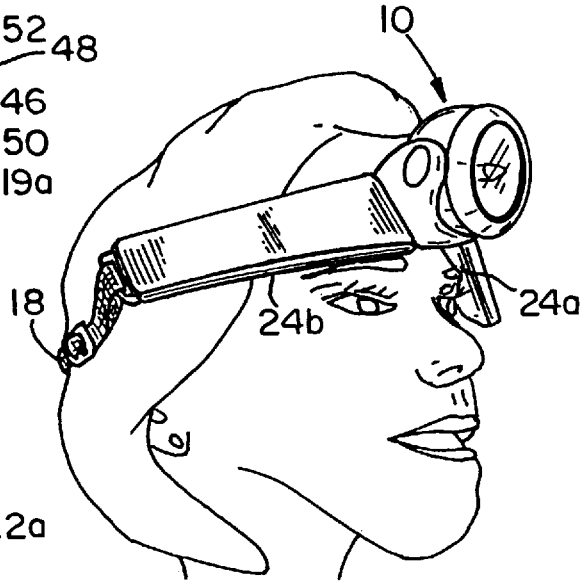
FIG. 8 is a perspective view of the flashlight in body-mountable use on a user's head.

Referring now to FIG. 3, the ends of the arms attached to the yoke are pivotally connected to respective diverging rear surfaces 15*a* and 15*b* of the yoke 14, such that the arms can be rotated about axes normal to the respective rear surfaces of the yoke 14. Such rotation of the arms causes the rear ends of the arms to swing apart from one another, as indicated by the alternative positions of the arms in FIG. 3. When the arms are each rotated 180° from the normal hand-held configuration about their pivotal connection or about axes 26*a* and 26*b,* respectively, the arms assume the alternative positions designated 16*a*' and 16*b*'. In the alternative positions of the arms, the flashlight 10 is converted to the body mountable configuration, in which the ends of the arms are widely separated, and the covers 24*a* and 24*b* are oriented to form a rear surface for contacting the head of the user. The flashlight may then be secured to the head of a user by positioning the covers 24*a* against the user's forehead, and placing the strap 18 around the rear of the user's head to secure the flashlight to the head. The flared contour of the covers on the arms 16*a* and 16*b* comfortably approximates the curvature of the average user's head as indicated in FIG. 8. As can be appreciated, the flashlight may be attached to other appendages, such as to the user's leg, if desired. The arms 16*a* and 16*b* of the flashlight may be provided with a latch (not shown) or with complementary abutment surfaces (not shown) for securing the arms together in the hand-held configuration.

Figure 4:
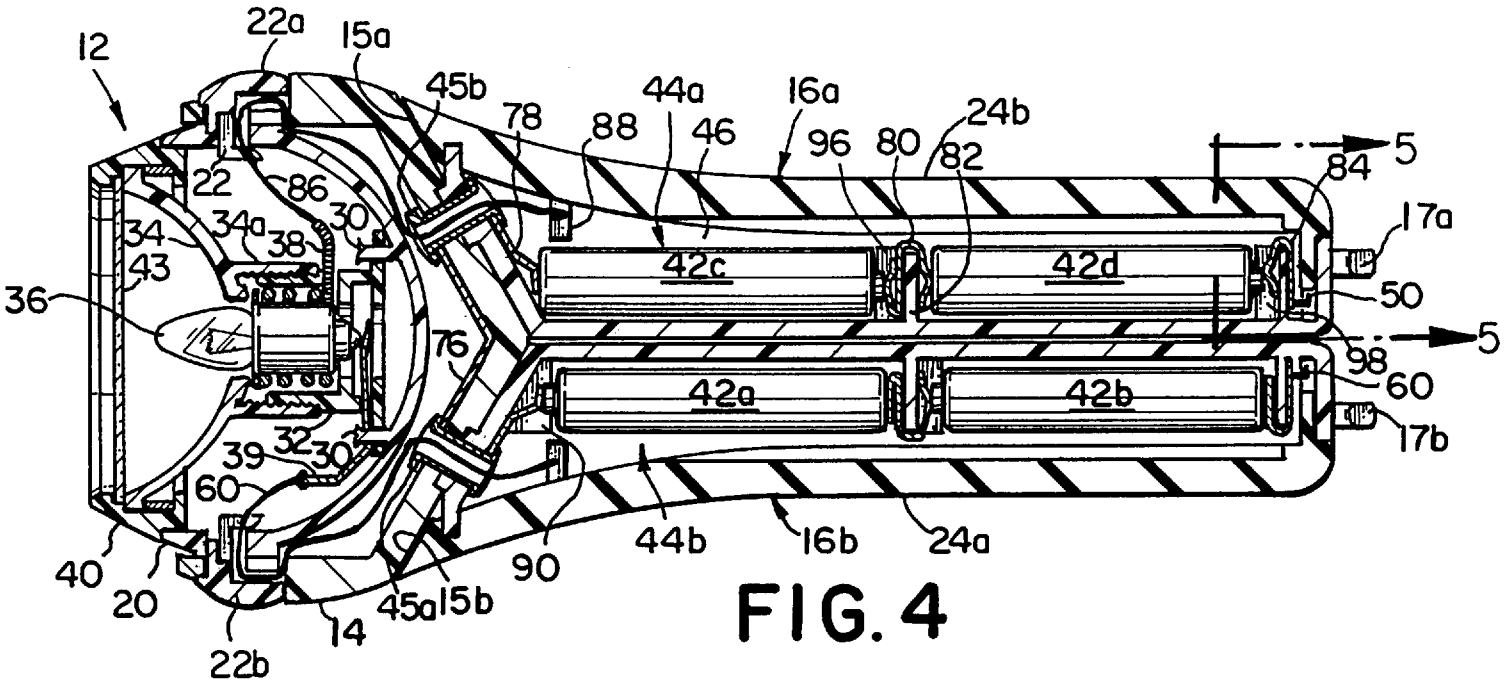
FIG. 4 is a sectional view of the flashlight taken along the line 4—4 shown in FIG. 2.

The internal structure of the flashlight 10 is shown most clearly in the sectional view of FIG. 4. The head housing 20 has mounting posts 30 formed therein for holding the base of a lamp socket 32 within the housing 20. The lamp socket 32 includes an externally-threaded cylindrical portion at its outer end for mating with an internally-threaded cylinder 34*a* which supports an integral paraboloidal reflector 34. A lamp 36 is positioned within the lamp socket 32. The globe of the lamp extends through a central opening in the reflector 34 in a customary manner. The lamp is biased in the forward direction within the lamp socket 32 by a spring 38. The bottom loop of the spring 38 is deformed to provide a tang 38*a* to extend through the cylindrical portion of the lamp socket into the interior of the head housing 20 to provide an electrical connection for one terminal of the lamp. A retaining collar formed upon the lamp abuts with the rim forming the opening in the reflector 34 to retain the lamp within the socket 34 against the bias of the spring. A second electrical connection for the lamp is provided by a conductor 39 positioned at the bottom of the lamp socket for contacting the bottom terminal of the lamp. The conductor 39 extends into the interior of the head housing 20 through an opening at the bottom of the cylindrical lamp socket.

The outer rim of the reflector, and the rim of a transparent lens 43, are held by an elastomeric ring 40, which is attached to a head housing. More specifically, the exterior peripheral surface of the ring 40 is formed to mate with the front opening of the head housing 20. The outer surface of ring 40 is textured to provide a gripping surface for rotating the ring clockwise or counterclockwise upon the lamp socket 32 for removal of the ring, lens and reflector unit to provide access to the lamp 36. In addition, the lamp is switched on by rotating the ring 40 in the clockwise direction so that the reflector is further screwed onto the lamp socket to urge the lamp 36 into contact with the conductor 39. The lamp is switched off by rotating the ring 40 in the counterclockwise direction so that the reflector is unscrewed from the lamp socket, thus allowing the spring to urge the lamp out of contact with the conductor 39. In alternative embodiments, the lamp may be maintained in continuous connection with respective electrical contacts, and other switching means may be provided, such as a conventional flashlight switch. Additionally, in such embodiments, the lamp may be maintained in a stationary position in the lamp socket so that relative movement of the reflector 34 upon the lamp socket may provide a variable focus mechanism for producing a desired divergence of the light beam projected from the flashlight.

Figure 6:
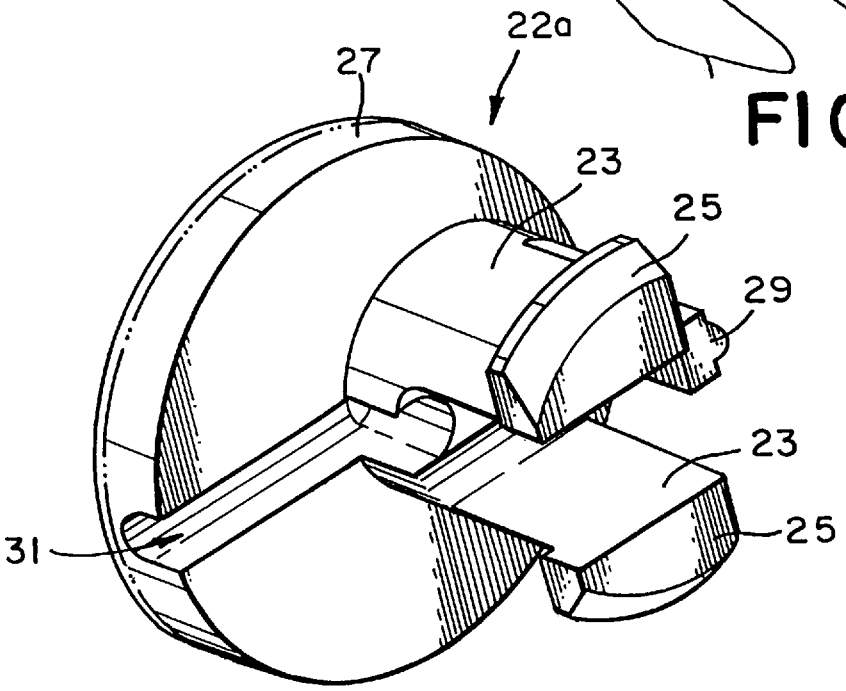
FIG. 6 is an enlarged perspective view of a pivot member for pivotally supporting the head of the flashlight.

The head housing 20 is attached to the yoke 14 by pivot pins 22*a* and 22*b*. Pivot pin 22*a* is shown in greater detail in the enlarged prospective view of FIG. 6. The pivot pin 22*a* is preferably a snap-fit fastener having a pair of flexible cantilevered arms 23*a* and 23*b* with outwardly-projecting enlarged end portions 25 formed thereon for engagement with the interior surface of the head housing 20. The exterior surfaces of the arms 23*a* and 23*b* are rounded to provide an axle for rotation of the head housing 20 thereon. Detents may be formed on the arms, or upon a separate detent projection 29, for sequential engagement with serrations (not shown) formed about the rim of the pivot-receiving aperture of the head housing 20. Such an arrangement allows the head housing 20 to be oriented at one a plurality of discrete angles or positions defined by the serrations. The base of the pivot 22*a* is enlarged relative to the diameter of the axle to provide a cap 27 for abutment with a complementary receiving cup formed on the outside of the yoke 14. A groove 31 is formed along the interior surface of the cap 27 from the rim of the cap 27 to a location between the arms 23*a* and *b*. The groove 31 provides a conduit for an electrical wire to extend between the cap 27 and the yoke 14, and then between the arms 23*a* and *b* into the interior of the head housing 20.

Referring again to FIG. 4, tubular bosses 56*a* and 56*b* are formed on the forward ends of the respective arm housings 19*a* and 19*b*. The bosses 56*a* and 56*b* are received by complementary depressions formed in the rear surfaces 15*a* and 15*b* of the yoke. The bosses 56*a* and 56*b* have central openings to receive tubular grommets 45*a* and 45*b* which pivotally secure the arm housings 19*a* and 19*b* to the yoke 14. The grommets 45*a* and 45*b* are preferably conductive for reasons described hereinbelow.

Electrical power for the flashlight is provided by batteries 42*a–d* located in battery compartments 44*a* and 44*b* within the arms 16*a* and 16*b*. In the preferred embodiment, the four batteries 42*a–d* are AA-size cells.

Figure 5:
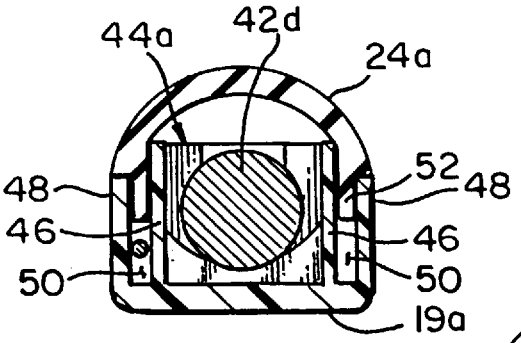
FIG. 5 is a sectional view of an arm of the flashlight taken along the line 5—5 shown in FIG. 4.

Referring now to FIG. 5, arm housing 19*a* includes interior walls 46 that are separated from the exterior walls 48, thus forming a channel 50 therebetween. The cover 24*a* has a projecting lip 52 that is adapted to extend into the channel 50 and is compressed therein to detachably retain the cover 24*a* to the arm housing 19*a*. The battery compartment 44*a* is thus bounded by the interior surface of the cover 24*a* and by the interior walls 46 of the arm housing 19*a*.

The electrical circuit provided within the flashlight can best be described by reference to FIG. 4. As previously mentioned, one of the electrical contacts to the lamp 36 is provided by conductor 39 located at the base of the lamp socket 32. The conductor 39 extends along the base of the lamp socket and is connected to a wire 60 within the head housing 20. The wire 60 extends within the head housing 20 and through the pivot pin 22*b*. More specifically, the pivot 22*b,* the wire 60 extends out of the head housing 20 between the cantilever arms of the pivot pin 22*b,* and along the groove formed in the cap of pivot 22*b* into the interior of the yoke 14. The wire 60 then extends from within the yoke 14 into the arm 16*b* through tubular grommet 45*a*. The wire 60 is preferably insulated and multi-stranded, so that the wire 60 is able to withstand being twisted when the head 12 is positioned at various angles and when the arm 16*b* is rotated between the hand-held configuration and the body-mountable configuration of the flashlight.

Figure 7:
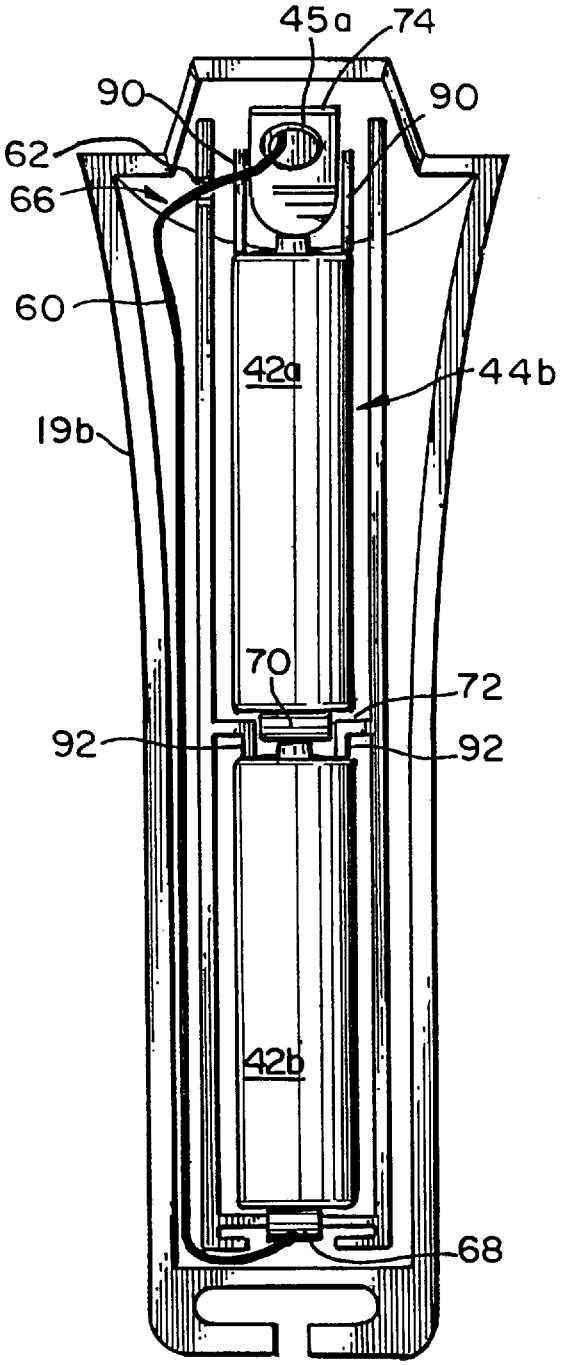
FIG. 7 is a top plan view of one of arms of the flashlight with its cover removed, showing the battery compartment therein.

Referring now to FIG. 7, the wire 60 enters the forward end of the battery compartment 44*b* within arm housing 19*b* through the grommet 45*a*. It should be appreciated that arm housing 19*a* of arm 16*a* is similarly arranged, except as noted in describing the orientation of the batteries. From the forward end of the battery compartment 44*b,* the wire 60 extends through a slot 62 formed in the sidewall 64 of the battery compartment 44*b* and into a channel 66 formed between the sidewall 64 and the outer wall of the arm housing 19*b*. The wire 60 then extends rearwardly within the channel 66 to a location beyond the distal end of the battery compartment 44*b*. At the distal end of the battery compartment 44*b,* the wire 60 is electrically connected with a spring contact member 68. The spring contact member 68 is mounted upon the end wall of battery compartment 44*b,* and is maintained in compressive contact with the negative terminal of battery 42*b*.

The positive terminal of battery 42*b* is maintained in compressive contact with one side of a spring contact member 70 mounted upon a baffle 72 formed within the battery compartment 44*b*. The other side of spring contact member 70 is maintained in compressive contact with the negative terminal of battery 42*a*. Batteries 42*a* and 42*b* are thus connected in series within battery compartment 44*b*. The positive terminal of battery 42*a* is maintained in compressive contact with a spring contact member 74. Spring contact member 74 is mounted against the forward end of the arm housing 19*b* by conductive grommet 45*a*. The spring contact member 74 is thereby maintained in electrical contact with the grommet 45*a* to permit electrical current to flow from the positive terminal of battery 42*a* and into the yoke 14 through the grommet 45*a*.

Referring again to FIG. 4, the forward end of grommet 45*a,* located within the yoke 14, holds one end of a conductor 76 against the rear interior surface of the yoke 14. The other end of conductor 76 is held against the rear interior surface of the yoke 14 by the forward end of conductive grommet 45*b*. Thus, electrical current from the grommet 45*a* is conducted via conductor 76 to grommet 45*b* and thence into the battery compartment 44*a* within arm housing 19*a*. The rear end of grommet 45*b* holds a spring contact member 78 at the forward end of battery compartment 44*a*. Spring contact member 78 is maintained in compressive contact with the negative terminal of battery 42*c*. The positive terminal of battery 42*c* is maintained in compressive contact with one end of a spring contact member 80, mounted upon baffle 82 formed in battery compartment 44*a,* as shown in FIG. 4. The other end of spring contact member 80 is maintained in compressive contact with the negative terminal of battery 42*d*. It should thus be appreciated that batteries 42*a–d* are connected in series, with two of the batteries 42*a* and 42*b* being held within one arm 16*b,* and the other two batteries 42*c* and 42*b* being held within the other arm 16*a*. The positive terminal of battery 42*d* compresses spring contact member 84 at the distal rear end of battery compartment 44*a*. A wire 86 is connected to the spring contact member 84. The wire 86 is routed along channel 50 from the rear of the arm housing 19*a* and enters the forward end of the battery compartment 44*a* through a slot 88 formed in the sidewall 46.

From within the forward end of the battery compartment 44*a,* the wire 86 extends through grommet 45*b* into the interior of the yoke 14. The wire 86 enters the head housing 20 through pivot 22*a* and is connected within the head housing to the spring 38, thus completing the electrical circuit to the lamp.

In the preferred embodiment shown in FIG. 4, four AA batteries are employed for powering the flashlight. The batteries 42*a* and 42*b* are both positioned within arm 16*b* with their positive terminals oriented toward the front of the flashlight. The batteries 42*c* and 42*d* are both positioned within arm 16*a* with their positive terminals oriented toward the rear of the flashlight. In alternative embodiments, all of the batteries may be oriented in the same direction, with a proper arrangement of interconnected conductors being provided within the yoke 14 for electrically connecting the batteries in series. It should be appreciated that the preferred arrangement of batteries allows the grommets 45*a* and 45*b* to provide an economical electrical connection to a bridging conductor 76 between the pairs of batteries located within the respective arms.

In battery-powered devices employing series-connected batteries, a user may inadvertently install one or more of the batteries into the battery compartment in an incorrect battery orientation. If, for example, one of the batteries is installed with its polarity in the incorrect direction, unusually high power dissipation can occur within the mis-oriented battery. Such unusually high power dissipation, in addition to prematurely discharging the battery, can cause the battery to overheat, leak, or explode. In a head-mounted device, any of these potential effects would be highly undesirable. The flashlight of the present invention incorporates means for preventing a mis-oriented battery from being electrically connected with the other batteries.

Referring again to FIG. 7, spacing ribs 90 are formed adjacent to respective opposite sides of the spring contact member 74 at the forward end of the battery compartment 44*b* within arm housing 19*b*. The ribs 90 extend rearward within the battery compartment and abut against the forward end of the battery 42*a*. The rearward extent of the ribs 90 within the battery compartment 44*b* is sufficient to allow the positive terminal of the battery 42*a* to make contact with the spring contact member 74. The ribs 90 extend slightly beyond the rear of the spring contact member 74 so that, if the battery 42*a* is placed into the battery compartment 44*b* in an incorrect orientation, the negative terminal of the battery 42*a* will be separated from the spring contact member 74. Hence, the battery 42*a* will be out of electrical connection and the electrical circuit of the flashlight. Similarly, ribs 92 are formed to extend rearward from baffle 72 along either side of spring contact member 70 for allowing the positive terminal of battery 42*b* to make contact with the spring contact member 70, while also preventing the negative terminal of battery 42*b* from making contact with the spring contact member 70, if the battery 42*b* is mis-oriented within the battery compartment. Within the other arm 16*a,* similar pairs of ribs 96 and 98 are formed alongside respective spring contact members 80 and 84 to allow exclusive electrical contact with only the positive terminals of the batteries 42*c* and 42*b* positioned therein to prevent connection of the batteries in the electrical circuit if the batteries are mis-oriented in the housings.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

That which is claimed is:

1. A flashlight, comprising a head portion having an interior containing a lamp, the head portion having a pair of angled rear surfaces relative to a longitudinal axis of the flashlight; and a pair of arms adapted to form a handle for the flashlight in a first configuration, each arm having a forward surface mounted to different ones of the angled surfaces of the head portion by pivotal mountings, the arms extending rearwardly and in parallel from the head in the first configuration, the arms being axially rotatable on the pivotal mountings to a second configuration wherein the arms diverge outwardly from the head portion.

2. The flashlight of claim 1 wherein the head portion comprises a yoke providing the angled surfaces of the head portion, and a head assembly pivotally held by the yoke and containing the lamp.

3. The flashlight of claim 1 wherein the arms are formed to provide respective battery compartments therein for containing batteries to power the lamp.

4. The flashlight of claim 3 comprising preventing means located in the battery compartments for preventing electrical connection between the lamp and an incorrectly installed battery.

5. The flashlight of claim 4 comprising battery contact members positioned within the battery compartments, and wherein said preventing means comprises a barrier positioned adjacent to at least one of the contact members such that said barrier extends outwardly alongside of the contact member and beyond the contact member by a distance less than the height of a standard flashlight battery terminal.

6. The flashlight of claim 3 in which the arms include removable battery compartment cover members forming respective outer side surfaces of the arms in the first configuration, and forming rear surfaces for the flashlight when the arms are rotated into the second configuration.

7. The flashlight of claim 6 wherein the each cover member comprises a resilient member that is contoured to be mounted upon a user's body in the second configuration.

8. The flashlight of claim 7 wherein the cover member is contoured to be mounted upon a user's head in the second configuration.

9. The flashlight of claim 8 comprising a resilient strap having respective ends connected with rear ends of the arms for securing the flashlight to the user's head in the second configuration.

10. The flashlight of claim 3 comprising a pair of conductive pivot members providing the pivotal mountings and for conducting electrical current from the batteries to the lamp.

11. The flashlight of claim 10 wherein the pivot members have respective openings formed therein for providing respective apertures between the battery compartments and the interior of the head portion.

12. The flashlight of claim 10 comprising a conductive member positioned in the head portion for electrically interconnecting the pivot members.

13. The flashlight of claim 1 wherein the head portion comprises:

a cylindrical socket mounted in the head portion for holding the lamp, the socket having a threaded surface;

a first contact member positioned at the rear of the socket;

a second contact member positioned within the socket and comprising biasing means for urging the lamp forwardly within the socket and away from the first contact member; and a reflector having an aperture aligned with the socket for permitting the lamp to extend through the aperture, the reflector having a rearwardly-extending threaded portion for mating with the threaded surface of the socket, and a rim formed about the aperture for urging the lamp toward the second contact member as the reflector is rotatably received onto the threaded surface of the socket.

14. The flashlight of claim 13 wherein the head portion further comprises a rotatable peripheral member positioned at a forward end of the head portion and joined with the reflector to permit rotation of the threaded portion of the reflector upon the threaded surface of the socket.

15. The flashlight of claim 13 wherein the head portion comprises a housing for containing the socket, and a yoke for pivotally holding the housing and providing the angled rear surfaces.

16. A flashlight, comprising:

a head portion containing a lamp, and having rear surfaces;

a pair of arms mounted to respective rear surfaces of the head portion and extending therefrom in parallel in a first configuration, the arms having battery holders formed therein to receive batteries for providing electrical power to the lamp;

preventing means positioned in the arms for preventing electrical connection between the lamp and an incorrectly installed battery;

a pair of pivot members for mounting the arms to the respective rear surfaces of the head portion, such that the arms are pivotable from the first configuration to a second configuration wherein the arms diverge outwardly from the head portion; and securing means for securing the flashlight to a user's body in the second configuration.

17. The flashlight of claim 16 comprising battery contact members positioned within the arms, and wherein said preventing means comprises a barrier positioned adjacent to at least one of the contact members such that said barrier extends outwardly alongside of the contact member and beyond the contact member by a distance less than the height of a standard flashlight battery terminal.

18. The flashlight of claim 16 wherein the head portion comprises a yoke providing the respective rear surfaces of the head portion, and a head assembly pivotally held by the yoke and containing the lamp.

19. The flashlight of claim 16 in which the arms include removable cover members forming respective outer side surfaces of the arms in the first configuration, and forming rear surfaces for the flashlight when the arms are pivoted into the second configuration.

* * * * *